US009512509B2

(12) United States Patent
Kurihara

(10) Patent No.: US 9,512,509 B2
(45) Date of Patent: Dec. 6, 2016

(54) DUPLEX STAINLESS STEEL

(75) Inventor: Shinnosuke Kurihara, Amagasaki (JP)

(73) Assignee: NIPPON STEEL & SUMITOMO METAL CORPORTION, Tokyo (JP)

( * ) Notice: Subject to any disclaimer, the term of this patent is extended or adjusted under 35 U.S.C. 154(b) by 97 days.

(21) Appl. No.: 14/004,201

(22) PCT Filed: Mar. 6, 2012

(86) PCT No.: PCT/JP2012/055619

§ 371 (c)(1),
(2), (4) Date: Sep. 10, 2013

(87) PCT Pub. No.: WO2012/121232

PCT Pub. Date: Sep. 13, 2012

(65) Prior Publication Data

US 2014/0003989 A1 Jan. 2, 2014

(30) Foreign Application Priority Data

Mar. 10, 2011 (JP) ..... 2011-052502

(51) Int. Cl.
*C22C 38/42* (2006.01)
*C22C 38/44* (2006.01)
(Continued)

(52) U.S. Cl.
CPC ..... *C22C 38/58* (2013.01); *C21D 6/004* (2013.01); *C21D 9/46* (2013.01); *C22C 38/001* (2013.01); *C22C 38/002* (2013.01); *C22C 38/005* (2013.01); *C22C 38/02* (2013.01); *C22C 38/04* (2013.01); *C22C 38/08* (2013.01);*C22C 38/16* (2013.01); *C22C 38/18* (2013.01); *C22C 38/20* (2013.01); *C22C 38/22* (2013.01); *C22C 38/40* (2013.01); *C22C 38/42* (2013.01); *C22C 38/44* (2013.01); *C22C 38/54* (2013.01); *C21D 2211/001* (2013.01); *C21D 2211/005* (2013.01)

(58) Field of Classification Search
CPC ..... C21D 2211/001; C21D 2211/005; C22C 38/42; C22C 38/44
See application file for complete search history.

(56) References Cited

U.S. PATENT DOCUMENTS 5,298,093 A * 3/1994 Okamoto ..... C22C 38/44 148/325
5,623,726 A * 4/1997 Kiiski ..... C22C 33/0285 419/23

(Continued)

FOREIGN PATENT DOCUMENTS

EP 1 561 834 8/2005
JP 62-253755 11/1987

(Continued)

OTHER PUBLICATIONS

"Glossary of Metallurgical and Metalworking Terms," Metals Handbook, ASM International, 2002, term(s): rare earth metal.*

(Continued)

*Primary Examiner* — Scott Kastler
*Assistant Examiner* — Vanessa Luk
(74) *Attorney, Agent, or Firm* — Clark & Brody

(57) ABSTRACT

A duplex stainless steel containing, by mass %: C: not more than 0.03%, Si: not more than 0.3%, Mn: not more than 3.0%, P: not more than 0.040%, S: not more than 0.008%, Cu: 0.2 to 2.0%, Ni: 5.0 to 6.5%, Cr: 23.0 to 27.0%, Mo: 2.5 to 3.5%, W: 1.5 to 4.0%, and N: 0.24 to 0.40%, the balance being Fe and impurities, wherein a σ phase susceptibility index X (=2.2Si+0.5Cu+2.0Ni+Cr+4.2Mo+0.2W) is not more than 52.0; a strength index Y (=Cr+1.5Mo+10N+3.5W) is not less than 40.5; and a pitting resistance equivalent PREW (=Cr+3.3(Mo+0.5W)+16N) is not less than 40. This duplex stainless steel is excellent in corrosion resistance and embrittlement cracking resistance.

2 Claims, 2 Drawing Sheets

(51) Int. Cl.

| | |
|---|---|
| ***C22C 38/58*** | (2006.01) |
| ***C22C 38/00*** | (2006.01) |
| ***C22C 38/02*** | (2006.01) |
| ***C22C 38/04*** | (2006.01) |
| ***C22C 38/54*** | (2006.01) |
| ***C21D 6/00*** | (2006.01) |
| ***C21D 9/46*** | (2006.01) |
| ***C22C 38/08*** | (2006.01) |
| ***C22C 38/16*** | (2006.01) |
| ***C22C 38/18*** | (2006.01) |
| ***C22C 38/20*** | (2006.01) |
| ***C22C 38/22*** | (2006.01) |
| ***C22C 38/40*** | (2006.01) |

(56) References Cited

U.S. PATENT DOCUMENTS

| | | | | |
|---|---|---|---|---|
| 2007/0089810 | A1* | 4/2007 | Sundstrom | C22C 38/001 148/325 |
| 2010/0084121 | A1* | 4/2010 | Kivisakk | C22C 38/001 165/166 |

FOREIGN PATENT DOCUMENTS

| | | |
|---|---|---|
| JP | 05-132741 | 5/1993 |
| JP | 09-241746 | 9/1997 |
| JP | 09-271811 | 10/1997 |
| JP | 2001-220652 | 8/2001 |
| JP | 2002-241838 | 8/2002 |
| JP | 2002-529599 | 9/2002 |
| JP | 2003-503596 | 1/2003 |
| JP | 2005-501969 | 1/2005 |
| JP | 2005-501970 | 1/2005 |
| JP | 2005-36313 | 2/2005 |
| JP | 2007-84837 | 4/2007 |
| JP | 2009-256791 | 11/2009 |
| WO | 2005/014872 | 2/2005 |

OTHER PUBLICATIONS

Computer-generated translation of JP 2007-084837 (Okada et al), originally published on Apr. 5, 2007.*

* cited by examiner

DUPLEX STAINLESS STEEL

TECHNICAL FIELD

The present invention relates to a duplex stainless steel consisting of a ferrite phase and an austenite phase.

BACKGROUND ART

Duplex stainless steels are excellent in corrosion resistance and weldability, and in particular excellent in sea-water corrosion resistance and strength compared to ferrite stainless steels or austenitic stainless steels. Accordingly, duplex stainless steels have been widely used for a long time as industrial materials for their easiness of reducing thickness and economic efficiency. Particularly, high Cr-high Mo duplex stainless steels are excellent in corrosion resistance and strength, and thus are used in various fields such as line pipes, components of heat exchangers, process steel tubes and pipes for oil and chemical industrial usage, and oil country tubular goods. Currently, because of increasing deeper sea oil wells and reduction in thickness of materials, materials having further higher strength are required in umbilical tubes for oil wells and others. Greater contents of Cr and Mo in duplex stainless steels, however, more likely cause precipitation of intermetallic compounds (σ phase, χ phase) that are hard and brittle in a temperature range of about 800 to 1000° C. This is because of the following reasons.

A solid billet of a duplex stainless steel is produced in such a manner that an ingot is hot-forged or hot-rolled into a longer-length cast piece, and the cast piece is allowed to cool, and thereafter the cast piece is subjected to machining such as cutting-off and cutting. In a high Cr-high Mo duplex stainless steel, a σ phase is likely to precipitate, in particular during air cooling, which significantly hardens a material thereof, and is likely to cause cracks, so that it becomes difficult to cut off or cut the material in various machining. Hence, it is preferable to suppress precipitation of the σ phase to be as small as possible in production of the duplex stainless steel, and various suggestions have been made, such as reduction in the contents of Cr and Mo, and modification of heat treatment conditions and cooling conditions.

For example, Patent Document 1 suggests a duplex stainless steel in which a phase stability index PSI (=3Si+Cr+3.3Mo) is defined to be 40 or less. Patent Document 1 describes that no σ phase or the like is formed under heating, heat treatment and welding conditions during normal hot working of this duplex stainless steel.

Patent Document 2 suggests a producing method of a duplex stainless steel that heats a duplex stainless steel at a temperature of 1110° C. or more, and subjects this steel to hot working into a seamless steel tube, in which the steel is reheated so as to have a temperature within a range satisfying 800+5Cr+25Mo+15W≤T(° C.)≤1150 after finishing rolling, and thereafter rapidly cools the steel. Patent Document 2 describes that it is possible to produce a high-strength duplex stainless steel tube having no precipitation of the σ phase, and excellent in corrosion resistance.

Patent Document 3 suggests a duplex stainless steel having ferrite amount and a PRE value that are adjusted to be within a predetermined range. Patent Document 3 describes that it is possible to produce a duplex stainless steel excellent in sea-water resistance through this configuration. Patent Document 4 suggests a duplex stainless steel whose Mo content is reduced so as to suppress formation of the σ phase, and having ferrite amount and a PREW value that are adjusted to be within respective predetermined ranges. Patent Document 4 describes that it is possible to produce a duplex stainless steel excellent in warm workability, crevice corrosion resistance, and structural stability through this configuration.

Patent Documents 5 and 6 suggest duplex stainless steels having ferrite amount, respective PREW values of an austenite phase and a ferrite phase, and a ratio therebetween that are adjusted to be within respective predetermined ranges. Both Patent Documents 5 and 6 describe that it is possible to produce a duplex stainless steel excellent in corrosion resistance and structural stability.

CITATION LIST

Patent Documents

[Patent Document 1] JP5-132741A
[Patent Document 2] JP9-241746A
[Patent Document 3] JP2002-529599A
[Patent Document 4] JP2003-503596A
[Patent Document 5] JP2005-501969A
[Patent Document 6] JP2005-501970A

SUMMARY OF INVENTION

Technical Problem

As mentioned above, decrease in the contents of Cr and Mo that are element enhancing corrosion resistance deteriorates corrosion resistance and strength required in a duplex stainless steel. On the other hand, in a steel whose contents of Cr and Mo are increased, the σ phase is likely to precipitate during air cooling, welding, and hot bending after hot forging or hot rolling. This tendency becomes significant particularly in large sized steel materials such as billets. Hence, precipitation of the σ phase cannot be suppressed by simply controlling chemical compositions, microstructure states, heat treatment conditions or the like of steels in the above prior arts.

An object of the present invention, which has been made in order to solve the problems according to the conventional art, is to provide a duplex stainless steel without deteriorating corrosion resistance required in the duplex stainless steel, capable of attaining high strengthening, suppressing cracks due to a thermal history during air cooling or welding of a billet by suppressing precipitation of the σ phase, and also excellent in machinability in various machining

Solution to Problem

In order to solve the above problems, the present inventors have investigated influences of various elements on the σ phase susceptibility, that is, impact values after aging treatment (900° C.×600 seconds) simulating a thermal history during air cooling and welding of each billet of various duplex stainless steels, and have studied precipitation noses of the σ phase and cooling curves during air cooling of the billets. As a result, it has been found that it is useful to adjust the chemical composition such that an σ phase susceptibility index X, which is comprehensively represented by Si, Cu, Ni, Cr, Mo, and W that are elements causing influences on the σ phase susceptibility, satisfies a predetermined condition.

The present inventors have studied influences on strength of each element, and as a result of this, it has been found that it is useful to adjust the chemical composition such that a strength index Y represented by Cr, Mo, W, and N, which are elements contributing to high strengthening, satisfies a predetermined condition. It is possible to provide a high-strength duplex stainless steel that suppresses the precipitation of the σ phase by adjusting the above indexes X and Y to satisfy the respective predetermined conditions at the same time.

The present invention has been accomplished based on the aforementioned findings, and the gist of the present invention is described by the duplex stainless steel in the following (a) and (b).

(a) A duplex stainless steel containing, by mass %:

C: not more than 0.03%, Si: not more than 0.3%, Mn: not more than 3.0%, P: not more than 0.040%, S: not more than 0.008%, Cu: 0.2 to 2.0%, Ni: 5.0 to 6.5%, Cr: 23.0 to 27.0%, Mo: 2.5 to 3.5%, W: 1.5 to 4.0%, and N: 0.24 to 0.40%; the balance being Fe and impurities, wherein a σ phase susceptibility index X represented by the following Formula (1) is not more than 52.0;

a strength index Y represented by the following Formula (2) is not less than 40.5; and a pitting resistance equivalent PREW represented by the following Formula (3) is not less than 40:

$$X=2.2Si+0.5Cu+2.0Ni+Cr+4.2Mo+0.2W \quad (1)$$

$$Y=Cr+1.5Mo+10N+3.5W \quad (2)$$

$$PREW=Cr+3.3(Mo+0.5W)+16N \quad (3)$$

where a symbol of each element in the Formulas (1), (2), and (3) denotes a content (mass %) of the element.

(b) The duplex stainless steel according to (a), further containing, by mass %, one or more elements selected from among Ca: not more than 0.02%, Mg: not more than 0.02%, B: not more than 0.02%, and rare earth elements: not more than 0.2%, in lieu of part of Fe.

Advantageous Effect of Invention

According to the present invention, the precipitation of the σ phase is suppressed, and thus it is possible to provide a duplex stainless steel capable of suppressing cracks during air cooling of a billet, and having excellent machinability of various machining.

DESCRIPTION OF EMBODIMENT

C: not more than 0.03%

Figure 1:
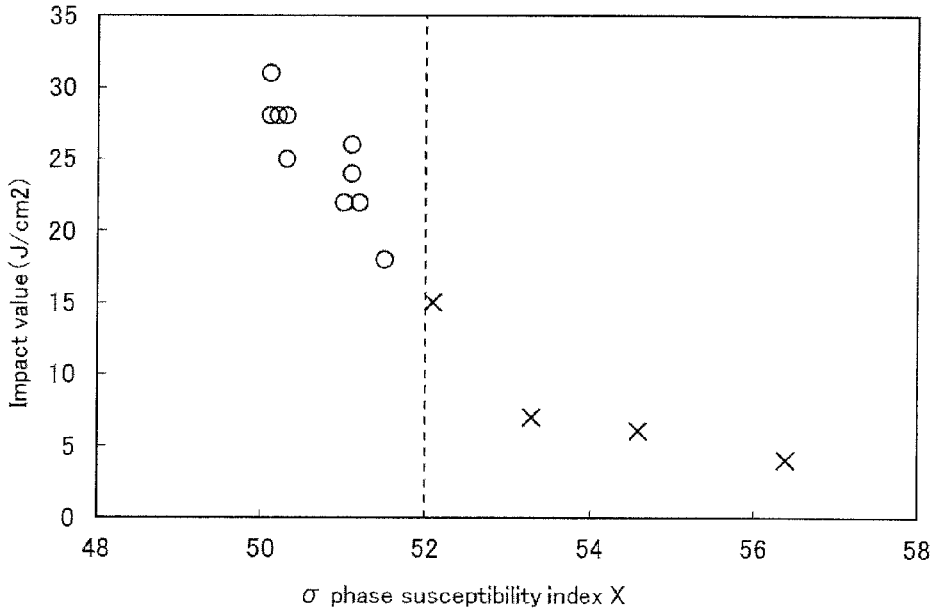
FIG. 1 is a drawing showing a relation between the σ phase susceptibility index X and the impact value after aging at 900° C. and 600 seconds.

C is effective in stabilizing an austenite phase. The excessive C content, however, is likely to cause precipitation of carbide, and deteriorates corrosion resistance. Accordingly, the C content is set to be not more than 0.03%. The preferable upper limit thereof is 0.02%.

Si: not more than 0.3%

Si is effective in deoxidation of the steel. However, Si is an element that encourages formation of the σ phase with its excessive content. Accordingly, the Si content is set to be not more than 0.3%. The preferable upper limit thereof is 0.25%. The above effect can be attained by a slight amount of Si, but the preferable Si content is not less than 0.01%, in particular if Si is added as a deoxidizer.

Mn: not more than 3.0%

Mn is effective in desulfurization and deoxidation during melting the steel, and also effective in stabilizing the austenite phase. Mn is an element contributing to enhancement of hot workability. Mn also has effect of increasing solubility of N. The excessive Mn content, however, deteriorates corrosion resistance. Accordingly, the Mn content is set to be not more than 3%. The preferable upper limit thereof is set to be 2.5%. The above effect can be attained by a slight amount of Mn, but it is preferable to contain Mn of not less than 0.01%, in particular if Mn is added for the purpose of desulfurization and deoxidation.

P: not more than 0.040%

P is an impurity element inevitably mixed in the steel, and the excessive P content significantly deteriorates corrosion resistance and toughness. Accordingly, the P content is restricted to be not more than 0.040%. The preferable upper limit thereof is 0.030%.

S: not more than 0.008%

S is an impurity element inevitably mixed in the steel, as similar to P, and deteriorates hot workability of the steel. Sulfide becomes initiation of pitting, and deteriorates pitting resistance. Accordingly, the S content is preferably suppressed to be as small as possible, and the S content of not more than 0.008% practically causes no problem. The preferable upper limit thereof is 0.005%.

Cu: 0.2 to 2.0%

Cu is particularly effective in enhancing corrosion resistance in a low-pH environment which is considered to have low reducibility, such as an environment of $H_2SO_4$ or hydrogen sulfide. In order to attain this effect, the Cu content should be not less than 0.2%. The excessive Cu content, however, deteriorates hot workability, and encourages formation of the σ phase. Accordingly, the Cu content is set to be not more than 2.0%. The preferable lower limit thereof is 0.3%, and the more preferable lower limit thereof is 0.4%. On the other hand, the preferable upper limit thereof is 1.5%, and the more preferable upper limit thereof is 0.8%.

Ni: 5.0 to 6.5%

Ni is an essential element to stabilize austenite. If the Ni content is excessively small, the amount of ferrite becomes excessively great, which hinders characteristics of the duplex stainless steel. Solubility of N into ferrite becomes too small, and nitride is likely to precipitate, resulting in deterioration of corrosion resistance. Accordingly, the Ni content is set to be not less than 5.0%. On the other hand, the excessive Ni content is likely to cause precipitation of the σ phase, and deteriorates toughness. Accordingly, the Ni content is set to be not more than 6.5%. The preferable lower limit thereof is 5.3%. On the other hand, the preferable upper limit thereof is 6.0%.

Cr: 23.0 to 27.0%

Cr is an essential basic component for securing corrosion resistance and strength. The excessively small Cr content cannot secure corrosion resistance enough for a so-called super duplex stainless steel. Accordingly, the Cr content is set to be not less than 23.0%. On the other hand, the excessive Cr content causes significant precipitation of the σ phase, which deteriorates corrosion resistance as well as hot workability and weldability. Accordingly, the Cr content is set to be not more than 27.0%. The preferable lower limit thereof is 25.0%. The preferable upper limit thereof is 26.0%.

Mo: 2.5 to 3.5%

Mo is effective in enhancing corrosion resistance, as similar to Cr, and in particular effective in enhancing pitting resistance and crevice corrosion resistance. Mo is also effective in high strengthening. Accordingly, the Mo content should be not less than 2.5%. On the other hand, the excessive Mo content is likely to cause precipitation of the σ phase. Accordingly, the Mo content is set to be not more than 3.5%. The Mo content is preferably set to be not less than 2.7%. The Mo content is also preferably set to be not more than 3.2%, and more preferably set to be less than 3.0%.

W: 1.5 to 4.0%

W forms fewer intermetallic compounds such as the σ phase, compared to Mo, and is an element of enhancing corrosion resistance, particularly enhancing pitting resistance and crevice corrosion resistance. W is also effective in high strengthening. The appropriate W content secures high corrosion resistance without increasing the contents of Cr, Mo, and N. However, the excessive W content rather saturates its advantageous effect of enhancing corrosion resistance. Accordingly, the W content is set to be 1.5 to 4.0%. The preferable lower limit thereof is 1.8%, and the more preferable lower limit thereof is 2.0%. The preferable upper limit thereof is 3.8%.

N: 0.24 to 0.40%

N is a strong austenite forming element, and effective in enhancing thermal stability and corrosion resistance as well as high strengthening of the duplex stainless steel. In order to attain an appropriate balance between the ferrite phase and austenite phase, an appropriate amount of N should be contained on the relation with the contents of Cr and Mo that are ferrite forming elements. N also has effect of enhancing corrosion resistance of alloy, as similar to Cr, Mo, and W. Hence, the N content should be not less than 0.24%. On the other hand, the excessive N content causes defects due to generation of blowholes, nitride formation due to thermal influences during welding or the like, resulting in deterioration of toughness and corrosion resistance of the steel. Accordingly, the N content is set to be not more than 0.40%. The N content is preferably set to be more than 0.30%, and more preferably set to be more than 0.32%.

One of the duplex stainless steels according to the present invention contains the above described elements within the above described ranges, and its balance is Fe and impurities. The impurities denote components that are mixed during industrially manufacturing the duplex stainless steel due to various factors, including raw materials such as minerals and scraps, as well as manufacturing processes, and are contained within an acceptable range of causing no bad influences to the present invention.

The other of the duplex stainless steels according to the present invention contains one or more elements selected from among Ca: not more than 0.02%, Mg: not more than 0.02%, B: not more than 0.02%, and rare earth elements: not more than 0.2% by mass %, in addition to the above elements.

Each of Ca, Mg, B, and the rare earth elements is an element for suppressing segregation of S as an impurity to the crystal grain boundaries, and enhancing hot workability; thus they may be contained in the duplex stainless steel according to the present invention. Their excessive contents, however, form more sulfide, oxide, carbide, and nitride that work as initiation of putting in the steel, which deteriorates corrosion resistance. Accordingly if one or more of the above elements is contained, each content of Ca, Mg, and B is preferably set to be not more than 0.02%, and the content of the rare earth elements is preferably set to be not more than 0.2%. Significant effect of enhancing hot workability can be achieved by a content of not less than 0.0003% of Ca, Mg, or B, or a content of not less than 0.01% of the rare earth elements. Only one or a combination of more than one of the Ca, Mg, B, and the rare earth elements may be contained. The total content of these elements is preferably set to be not more than 0.25% if more than one of these elements are added.

The rare earth elements (REM) collectively denote a total of 17 elements including Sc and Y in addition to lanthanide series, and one or more selected from these elements may be contained in the steel. The REM content denotes the total amount of the above elements.

The σ phase susceptibility index X: not more than 52.0

Among the above chemical components, Si, Cu, Ni, Cr, Mo, and W are elements that easily form the σ phase, so that the contents of these elements should be within their predetermined ranges, and the σ phase susceptibility index X represented by the Formula (1) below should be not more than 52.0. Adjustment of the chemical composition such that the σ phase susceptibility index X becomes not more than 52.0 makes it easy to set the impact value (JIS Z 2242: 2005) after aging at 900° C. and 600 seconds to be not less than 20 J/cm$^2$, thereby attaining excellent embrittlement cracking resistance. The σ phase susceptibility index X is preferably set to be not more than 51.0.

$$X=2.2Si+0.5Cu+2.0Ni+Cr+4.2Mo+0.2W \quad (1)$$

where a symbol of each element in the Formula (1) denotes a content (mass %) of the element.

Strength index Y: not less than 40.5

Among the above chemical components, Cr, Mo, W, and N are solid-solution strengthening elements for contributing to high strengthening, so that the contents of these elements should be within their predetermined ranges, and the strength index Y represented by the Formula (2) below should be not less than 40.5. Adjustment of the chemical composition such that the strength index Y becomes not less than 40.5 sets the 0.2% yield stress YS to be 620 MPa, thereby achieving the high strengthening. The strength index Y is preferably set to be not less than 41.5 in order to attain sufficient high strengthening effect.

$$Y=Cr+1.5Mo+10N+3.5W \quad (2)$$

where a symbol of each element in the Formula (2) denotes a content (mass %) of the element.

Pitting resistance equivalent PREW: not less than 40

Among the above chemical components, the contents of the elements of Cr, Mo, W and N should be within their predetermined ranges, and in order to enhance corrosion resistance, particularly sea-water corrosion resistance of the duplex stainless steel of the present invention, the pitting resistance equivalent PREW represented by the Formula (3) below should be not less than 40. In general, the pitting resistance equivalent PREW is adjusted to be not less than 35, but in the duplex stainless steel of the present invention, the contents of Cr, Mo, and N are increased such that PREW becomes not less than 40. Through this configuration, it is possible to attain significantly excellent corrosion resistance.

$$PREW=Cr+3.3(Mo+0.5W)+16N \quad (3)$$

where a symbol of each element in the Formula (3) denotes a content (mass %) of the element.

Example 1

The duplex stainless steels of 10 kg having the chemical compositions shown in Table 1 were melted in a VIM melting furnace, and the cast pieces were retained at a temperature of 1250° C. for two hours, and thereafter, were hot-forged into plate materials having a thickness of 30 mm. Subsequently, the produced plate materials were subjected to solution heat treatment at a temperature of 1110° C. for 30 minutes, and then were water-quenched.

The σ phase susceptibility was evaluated based on the impact value after aging at 900° C. and 600 seconds. Specifically, V-notch test specimens collected from the plate materials after the solution heat treatment were aged, and thereafter, the impact value for each test specimen was measured in compliance with JIS Z 2242 (2005). With respect to corrosion resistance (sea-water corrosion resistance), a critical pitting temperature CPT was measured for each test specimen by conducting a pitting test on each plate material after the solution heat treatment. The pitting test was carried out in compliance with the pitting test method using ferric chloride specified by ASTM G48. With respect to strength, No. 10 test specimens of JIS Z2201 (1998) were collected from the plate materials after the solution heat treatment, and a tensile test was conducted on each test specimen at a normal temperature. These results are shown in Table 2.

TABLE 2-continued

| Division | | σ phase susceptibility index X | Strength index Y | Impact value (J/cm$^2$) | YS (MPa) | PREW | CPT (° C.) |
|---|---|---|---|---|---|---|---|
| | 12 | 56.4* | 39.6* | 4 | 603 | 42.9 | 80 |
| | 13 | 54.6* | 38.7* | 6 | 585 | 42.0 | 70 |
| | 14 | 51.0 | 39.7* | 22 | 598 | 43.1 | 80 |

The mark * indicates out of the scope of the invention

FIG. 1 is a drawing showing a relation between the σ phase susceptibility index X represented by the Formula (1) and the impact value after the aging at 900° C. and 600 seconds, with respect to Examples shown in Table 1 and Table 2. As shown in FIG. 1, the impact value becomes greater as the σ phase susceptibility index X becomes smaller, and the precipitation of the σ phase is more suppressed. In particular, adjustment of the chemical composition such that the σ phase susceptibility index X is not more than 52.0 significantly suppresses the precipitation of the σ phase. Hence, the σ phase susceptibility index X is useful for evaluation of precipitation of the σ phase as well as an evaluation method of crack susceptibility during air cooling of a billet.

Figure 2:
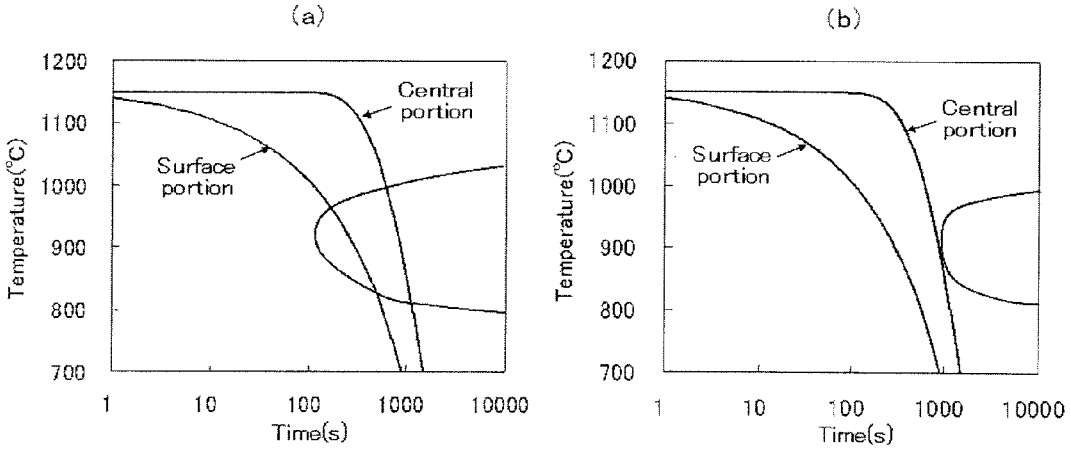
FIG. 2 are drawings showing precipitation noses of the σ phase estimated based on the impact value evaluation, and cooling curves during air cooling of solid billets having an outer diameter of 180 mm.

FIG. 2 are drawings showing precipitation noses of the σ phases that are estimated based on the impact value evaluation, and cooling curves during air cooling of the solid billets having an outer diameter of 180 mm, with respect to the duplex stainless steels of Inventive Example 6, and of Comparative Example 10. FIG. 2(*a*) shows a result of Comparative Example 10, and FIG. 2(*b*) shows a result of Inventive Example 6.

Only small practical influence due to precipitation of the σ phase is caused at the impact value of 18 J/cm$^2$ after the aging; therefore, the precipitation nose of the σ phase is distinguished at around the impact value of 18 J/cm$^2$. Cooling speeds of the surface portion and the central portion during air cooling of each billet are calculated using a heat transfer equation represented by the Formula below, and the cooling curves are plotted in FIG. 2.

$$\frac{\Delta r}{2}\rho Cp\left(\frac{\partial T}{\partial t}\right) = -\lambda\left(\frac{\partial T}{\partial r}\right) + h(T_\infty - T)$$

TABLE 1

| Division | | Chemical composition (mass % Balance: Fe and impurities) | | | | | | | | | | | | | |
|---|---|---|---|---|---|---|---|---|---|---|---|---|---|---|---|
| | | C | Si | Mn | P | S | Cu | Ni | Cr | Mo | W | N | Ca | B | Nd |
| Inventive examples | 1 | 0.015 | 0.21 | 0.99 | 0.020 | 0.0017 | 0.46 | 5.87 | 25.0 | 2.97 | 2.19 | 0.355 | — | — | — |
| | 2 | 0.015 | 0.26 | 0.99 | 0.020 | 0.0016 | 0.45 | 5.83 | 25.4 | 2.87 | 2.20 | 0.344 | — | — | — |
| | 3 | 0.015 | 0.25 | 1.00 | 0.021 | 0.0010 | 0.46 | 5.89 | 26.1 | 2.88 | 2.17 | 0.356 | — | — | — |
| | 4 | 0.015 | 0.22 | 0.49 | 0.020 | 0.0008 | 0.45 | 5.97 | 26.1 | 2.86 | 2.50 | 0.349 | 0.0014 | — | — |
| | 5 | 0.016 | 0.22 | 0.49 | 0.020 | 0.0009 | 0.44 | 5.98 | 25.6 | 2.87 | 3.02 | 0.323 | — | 0.0031 | — |
| | 6 | 0.016 | 0.23 | 0.49 | 0.017 | 0.0009 | 0.45 | 6.27 | 25.1 | 2.63 | 3.48 | 0.309 | 0.0017 | 0.0025 | — |
| | 7 | 0.016 | 0.23 | 0.49 | 0.017 | 0.0009 | 0.44 | 6.31 | 25.0 | 2.58 | 3.96 | 0.311 | — | — | — |
| | 8 | 0.014 | 0.24 | 1.96 | 0.019 | 0.0017 | 0.46 | 5.30 | 25.0 | 3.20 | 2.07 | 0.388 | 0.0028 | 0.0018 | — |
| | 9 | 0.016 | 0.22 | 0.49 | 0.019 | 0.0009 | 0.46 | 6.25 | 25.2 | 3.01 | 3.44 | 0.310 | — | — | 0.02 |
| Comparative examples | 10 | 0.014 | 0.30 | 0.47 | 0.021 | 0.0012 | 0.46 | 6.70* | 25.1 | 3.16 | 2.19 | 0.280 | — | — | — |
| | 11 | 0.015 | 0.22 | 0.49 | 0.023 | 0.0015 | 0.47 | 6.15 | 25.2 | 3.21 | 2.07 | 0.266 | — | — | — |
| | 12 | 0.016 | 0.97* | 0.49 | 0.019 | 0.0011 | 0.47 | 7.60* | 25.2 | 3.15 | 2.08 | 0.246 | — | — | — |
| | 13 | 0.018 | 0.29 | 0.52 | 0.019 | 0.0014 | 4.92* | 6.76* | 24.9 | 3.01 | 1.95 | 0.246 | — | — | — |
| | 14 | 0.015 | 0.14 | 0.49 | 0.018 | 0.0014 | 0.47 | 5.86 | 25.0 | 3.19 | 2.09 | 0.261 | — | — | — |

The mark * indicates out of the scope of the invention

TABLE 2

| Division | | σ phase susceptibility index X | Strength index Y | Impact value (J/cm$^2$) | YS (MPa) | PREW | CPT (° C.) |
|---|---|---|---|---|---|---|---|
| Inventive examples | 1 | 50.3 | 40.6 | 25 | 635 | 44.1 | 75 |
| | 2 | 50.3 | 40.9 | 28 | 645 | 44.0 | 75 |
| | 3 | 51.1 | 41.6 | 24 | 655 | 44.9 | 75 |
| | 4 | 51.2 | 42.6 | 22 | 654 | 45.2 | 75 |
| | 5 | 51.1 | 43.7 | 26 | 668 | 45.3 | 80 |
| | 6 | 50.1 | 44.3 | 31 | 698 | 44.5 | 80 |
| | 7 | 50.1 | 45.9 | 28 | 692 | 45.1 | 80 |
| | 8 | 50.2 | 41.0 | 28 | 624 | 45.2 | 70 |
| | 9 | 51.5 | 44.9 | 18 | 678 | 45.8 | 80 |
| Comparative examples | 10 | 53.3* | 40.3* | 7 | 588 | 43.6 | 80 |
| | 11 | 52.1* | 39.9* | 15 | 597 | 43.5 | 75 |

-continued $$h = 2.51C\left(\frac{\Delta T}{L}\right)^{0.25}$$

Δr: position from billet center (m)
ρ: density 7900 (kg/m$^3$)
Cp: specific heat 500 (J/kg/K)
T: billet temperature (° C.)
t: elapsed time after start of air cooling (s)
λ: thermal conductivity 14 (W/m/K) (value corrected based on the actual measurement value of the outer surface temperature during air cooling of each billet having an outer diameter of 180ϕ after hot forging (finishing temperature of 900° C.))
$T_\infty$: boundary condition of temperature 300 (° C.) (this calculation is repetitively carried out until the outer surface temperature of each billet after air cooling reaches 300° C.)
C: coefficient 0.55 in the case of having a cylindrical shape
ΔT: difference in temperature (° C.) from that of boundary condition $T_\infty$
L: billet length 3 (m)
Starting temperature of cooling: 1150° C.

As shown in FIG. 2, in Inventive Example 6, the σ phase susceptibility index X specified in the present invention is not more than 52.0, and the precipitation of the σ phase is significantly suppressed, and the precipitation nose of the σ phase shifts toward the long time region, compared to Comparative Example 10. In Comparative Example 10, both cooling curves of the surface portion and the central portion of the billet reach the precipitation nose of the σ phase, which indicates that the precipitation of the σ phase is generated during air cooling. To the contrary, in Inventive Example 6, the cooling curve of the central portion of the billet where the cooling speed becomes slower does not reach the precipitation nose of the σ phase, which reveals that the precipitation of the σ phase is suppressed. As aforementioned, adjustment of the chemical composition such that the σ phase susceptibility index X is not more than 52.0 encourages the precipitation of the σ phase during air cooling of the billet, thereby attaining embrittlement-cracking resistance, that is, suppressing cracks of the billet, resulting in enhancement of machinability of various machining.

For the purpose of further verification of the above effect of suppressing precipitation of the σ phase, with respect to billets having outer diameters of 205 mm, 245 mm, and 285 mm in addition to a billet having an outer diameter of 180 mm, a cooling curve was calculated for various depths from the surface of each billet using the above heat transfer equation, and a depth that allows for suppression of the σ phase was investigated for each billet based on the relation between the calculated cooling curves and the precipitation nose of the σ phase of Inventive Example 5.

Figure 3:
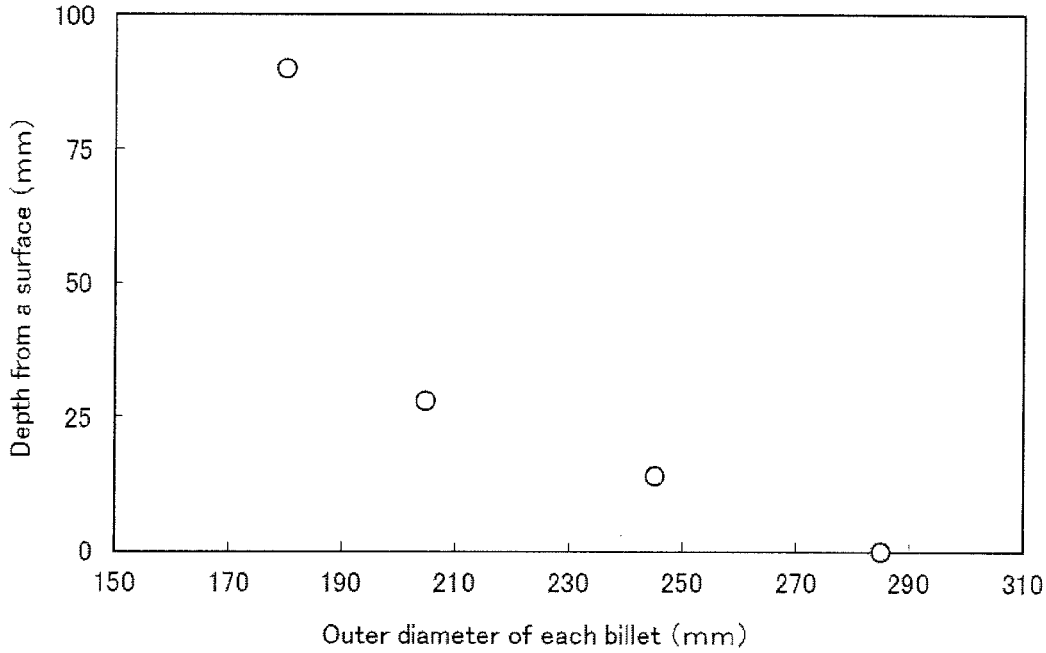
FIG. 3 is a drawing showing a relation between the outer diameter of each billet and the maximum depth from the surface of each billet where precipitation of the σ phase is suppressed during air cooling.

FIG. 3 is a drawing showing a relation between the outer diameter of each billet and the maximum depth from the surface of each billet where the precipitation of the σ phase is suppressed during air cooling. As shown in FIG. 3, in the billet having the outer diameter of as great as 285 mm, the σ phase precipitates to the outer surface, but in the billet having the outer diameter of 245 mm, the precipitation of the σ phase is suppressed to a depth of approximately 1/10r (r denotes a radius of the billet) from its surface. In the billet having the outer diameter of 205 mm, the precipitation of the σ phase is suppressed to a depth of approximately 1/4r from the surface. As the outer diameter becomes greater, the depth where the effect of suppressing the precipitation of the σ phase reaches becomes shallower, but it is confirmed that machinability can be enhanced even in the billet having the outer diameter of more than 180 mm.

Figure 4:
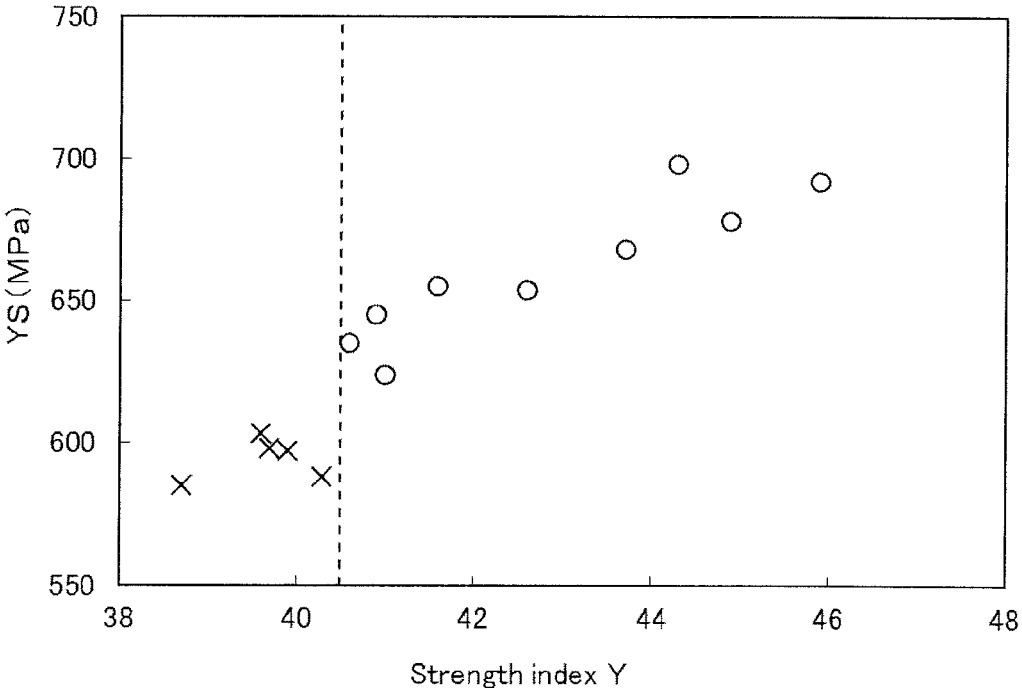
FIG. 4 is a drawing showing a relation between the strength index Y and the 0.2% yield stress YS.

FIG. 4 is a drawing showing a relation between the strength index Y and the 0.2% yield stress YS. As shown in FIG. 4, as the strength index becomes greater, the 0.2% yield stress YS becomes greater, and in particular, adjustment of the chemical composition such that the strength index becomes not less than 41.5 further enhances the high strengthening effect. Accordingly, the strength index Y is useful as a strength evaluation method of a material.

As shown in Table 1 and Table 2, each of Inventive Examples 1 to 9 attained the impact value of not less than 18 J/cm$^2$ after the aging at 900° C. and 600 seconds, and the precipitation of the σ phase was significantly suppressed. Accordingly, it is possible to suppress cracks during air cooling of each billet, and to enhance machinability of various machining. Each of Inventive Examples 1 to 9 had the strength index Y of not less than 40.5, and the 0.2% yield stress YS of not less than 620 MPa, which reveals attainment of high strengthening. In addition, Inventive Examples 1 to 9 had the pitting resistance equivalent PREW of not less than 40, and the critical pitting temperature CPT of not less than 70° C.

To the contrary, Comparative Examples 10 to 14 are examples having the σ phase susceptibility index X of more than 52.0 and the strength index Y of less than 40.5. In particular, Comparative Example 10 had the Ni content out of the range specified in the present invention, Comparative Example 11 had the chemical composition within the range specified in the present invention, but had the 6 phase susceptibility index X and the strength index Y that were out of the range specified in the present invention, Comparative Example 12 had the Si content out of the range specified in the present invention, and Comparative Example 13 had the Cu and Ni contents out of the range specified in the present invention. Each of these Comparative Examples had a smaller impact value after the aging at 900° C. and 600 seconds, and suppression of the precipitation of the σ phase was insufficient. Hence, it is estimated that cracks may be caused during air cooling of the billets. Each of these Comparative Examples had the 0.2% yield stress YS of less than 620 MPa, which reveals insufficient high strengthening. Comparative Example 14 had the chemical composition and the σ phase susceptibility index X within the range specified in the present invention, but had the strength index Y out of the range specified in the present invention. In this Comparative Example, the 0.2% yield stress YS was less than 620 MPa, which reveals insufficient high strengthening.

INDUSTRIAL APPLICABILITY

According to the alloy of the present invention, the chemical composition design of the alloy is adjusted so as to enhance PREW and allow the σ phase susceptibility index X and the strength index Y to satisfy their predetermined conditions, thereby providing a high-strength duplex stainless steel in which precipitation of the σ phase is suppressed, cracks due to a thermal history of a billet having a particular outer diameter during air cooling and welding the billet are reduced, and difficulties in machinability of various machining are solved, and which is excellent in the σ phase susceptibility and corrosion resistance. Accordingly, the alloy of the present invention is preferably applicable to not only umbilical tubes especially required to have enhanced strength and corrosion resistance, but also line pipes, components of heat exchangers, process steel tubes and pipes for oil and chemical industrial usage, and oil country tubular goods.

The invention claimed is:

1. A duplex stainless steel having a chemical composition consisting of, by mass %:

C: not more than 0.03%, Si: not more than 0.3%, Mn: not more than 3.0%, P: not more than 0.040%, S: not more than 0.008%, Cu: 0.2 to 2.0%, Ni: 5.0 to 6.5%, Cr: 23.0 to 27.0%, Mo: 2.5 to 3.5%, W: 1.5 to 4.0%, and N: 0.24 to 0.40%, the balance being Fe and impurities, wherein a σ phase susceptibility index X represented by the following Formula (1) is not more than 52.0;

a strength index Y represented by the following Formula (2) is not less than 40.5; and a pitting resistance equivalent PREW represented by the following Formula (3) is not less than 40:

$$X=2.2Si+0.5Cu+2.0Ni+Cr+4.2Mo+0.2W \quad (1)$$

$$Y=Cr+1.5Mo+10N+3.5W \quad (2)$$

$$PREW=Cr+3.3(Mo+0.5W)+16N \quad (3)$$

where a symbol of each element in the Formulas (1), (2), and (3) denotes a content (mass %) of the element, wherein an impact value regulated by JIS Z 2242 (2005) after aging at 900° C. and 600 seconds is not less than 18 J/cm$^2$ and a 0.2% yield stress after solution heat treatment obtained by a tensile test using No. 10 test specimen of JIS Z 2201 (1998) is not less than 620 MPa.

2. A duplex stainless steel having a chemical composition consisting of, by mass %, C: not more than 0.03%, Si: not more than 0.3%, Mn: not more than 3.0%, P: not more than 0.040%, S: not more than 0.008%, Cu: 0.2 to 2.0%, Ni: 5.0 to 6.5%, Cr: 23.0 to 27.0%, Mo: 2.5 to 3.5%, W: 1.5 to 4.0%, N: 0.24 to 0.40%, and one or more elements selected from among Ca: not more than 0.02%, Mg: not more than 0.02%, and B: not more than 0.02%, the balance being Fe and impurities, wherein a σ phase susceptibility index X represented by the following Formula (1) is not more than 52.0;

a strength index Y represented by the following Formula (2) is not less than 40.5; and a pitting resistance equivalent PREW represented by the following Formula (3) is not less than 40:

$$X=2.2Si+0.5Cu+2.0Ni+Cr+4.2Mo+0.2W \quad (1)$$

$$Y=Cr+1.5Mo+10N+3.5W \quad (2)$$

$$PREW=Cr+3.3(Mo+0.5W)+16N \quad (3)$$

where a symbol of each element in the Formulas (1), (2), and (3) denotes a content (mass %) of the element, wherein an impact value regulated by JIS Z 2242 (2005) after aging at 900° C. and 600 seconds is not less than 18 J/cm$^2$ and a 0.2% yield stress after solution heat treatment obtained by a tensile test using No. 10 test specimen of JIS Z 2201 (1998) is not less than 620 MPa.

* * * * *